US011815343B2

(12) United States Patent
Holstine et al.

(10) Patent No.: US 11,815,343 B2
(45) Date of Patent: Nov. 14, 2023

(54) DUAL INPUT ACTUATOR FOR AN OUTPUT DEVICE

(71) Applicant: AMI Industries, Inc., Colorado Springs, CO (US)

(72) Inventors: Steve Holstine, Colorado Springs, CO (US); Kassidy L. Carson, Colorado Springs, CO (US); Jeff Benjamin, Colorado Springs, CO (US); John Hampton, Colorado Springs, CO (US); Luis G. Interiano, Galt, CA (US)

(73) Assignee: AMI INDUSTRIES, INC., Colorado Springs, CO (US)

( * ) Notice: Subject to any disclaimer, the term of this patent is extended or adjusted under 35 U.S.C. 154(b) by 240 days.

(21) Appl. No.: 17/185,547

(22) Filed: Feb. 25, 2021

(65) Prior Publication Data

US 2022/0268561 A1 Aug. 25, 2022

(51) Int. Cl.
*F42C 7/12* (2006.01)

(52) U.S. Cl.
CPC ..... *F42C 7/12* (2013.01)

(58) Field of Classification Search
CPC ..... F42C 7/12
See application file for complete search history.

(56) References Cited

U.S. PATENT DOCUMENTS 2,828,691 A * 4/1958 Webster ..... F42C 7/12 102/470
3,064,538 A * 11/1962 Leaman ..... F41A 19/29 89/1.8
3,099,961 A * 8/1963 Stott ..... F42C 7/12 102/230
3,277,785 A * 10/1966 Clayton ..... F42C 15/20 102/306
3,283,657 A * 11/1966 Kvavle ..... B25C 1/085 89/7
3,356,320 A * 12/1967 Webb ..... B64D 25/10 244/122 AH
3,576,103 A * 4/1971 Kahn ..... F42C 7/12 89/7
3,992,999 A 11/1976 Chevrier et al.
4,188,856 A 2/1980 Bendler et al.
(Continued)

FOREIGN PATENT DOCUMENTS

EP 3176090 6/2017
WO 8902769 4/1989

OTHER PUBLICATIONS

United Kingdom Intellectual Property Office, United Kingdom Search Report dated Aug. 19, 2022 in Application No. GB2202574.6.

*Primary Examiner* — Derrick R Morgan
(74) *Attorney, Agent, or Firm* — SNELL & WILMER L.L.P.

(57) ABSTRACT

An output device and/or an output device assembly configured to be initiated in response to different types of input. The disclosed output device may be generally configured so as to be able to receive different types of input in order to produce an output. For example, the two different types of input may be mechanical force and fluid pressure, and thus the disclosed output device may be able to receive either form of input and convert either input into the desired/predetermined output.

15 Claims, 3 Drawing Sheets

(56) References Cited

U.S. PATENT DOCUMENTS

| | | | | |
|---|---|---|---|---|
| 5,036,660 | A * | 8/1991 | Aronne | F42C 7/12 60/671 |
| 5,887,825 | A | 3/1999 | Noel | |
| 8,250,980 | B1 * | 8/2012 | Mackie-Smith | F41A 19/08 102/260 |

* cited by examiner

DUAL INPUT ACTUATOR FOR AN OUTPUT DEVICE

FIELD

The present disclosure relates to actuators, and in particular to an output device capable of receiving different types of input to trigger an output.

BACKGROUND

Various systems utilize output devices to convert a type of motion, force, or energy into an output. In certain situations, multiple output devices in series are employed in order to have a chain of conversions between specific inputs to specific outputs. Accordingly, when multiple different types of inputs are involved (e.g., mechanical, electrical, fluid pressure, etc.), conventional systems typically include a specific output device to handle each specific type of input, and thus the associated cost, expense, and design complexity of such systems have various disadvantages and/or shortcomings.

SUMMARY

In various embodiments, the present disclosure provides an output device comprising a housing and a moveable member. The housing may define a chamber and the moveable member may be disposed within the chamber. The moveable member may be configured to undergo activation movement within the chamber to produce an output. In various embodiments, the output device is configured such that the activation movement can be initiated in response to two different types, separately, of input. In various embodiments, the two different types of input comprise mechanical force on the moveable member and fluid pressurization of the chamber.

In various embodiments, the output device further includes a primer for a ballistic combustion system, wherein the moveable member comprises a firing pin such that the activation movement of the firing pin provides an initiating impact force to the primer. In various embodiments, the output device further includes a sear pin coupled to the firing pin. The output device may be configured such that mechanical force on the sear pin produces the activation movement of the firing pin. In various embodiments, the output device also includes a piston disposed within the chamber between the sear pin and the firing pin. The sear pin may be releasably coupled to the piston.

The output device may also include a coil spring disposed around a shaft portion of the piston, with the coil spring being retained between a piston head of the piston and a shoulder of the housing. Compression of the coil spring in a first direction, in response to mechanical force on the sear pin, and subsequent expansion of the coil spring in a second direction opposite the first direction may produce the activation movement.

In various embodiments, the output device further includes a sleeve disposed around the shaft portion of the piston. The sleeve may be configured to extend between and abut the shoulder of the housing and the piston head of the piston to limit the extent of travel of the piston in the first direction in order to limit compression of the coil spring. In various embodiments, the output device is configured to release the sear pin from the piston in response to a predetermined threshold linear translation, thereby causing the subsequent expansion of the coil spring to propel the piston toward the firing pin to produce the activation movement. In various embodiments, the firing pin is retained in place using a shear pin, wherein in response to the piston impacting the firing pin the shear pin is configured to break to allow for the activation movement of the firing pin.

In various embodiments, the housing defines a fluid inlet port, with the output device being configured such that fluid pressurization of the chamber via the fluid inlet port produces the activation movement of the firing pin. In various embodiments, the output device further comprises a piston disposed within the chamber and a spacer disposed between the piston and the firing pin. An annular chamber may be defined between the spacer and the housing, wherein the fluid inlet port is directly open to the annular chamber. In various embodiments, the firing pin is retained in place using a shear pin, wherein in response to fluid pressurization of the chamber, the shear pin is configured to break to allow for the activation movement of the firing pin.

Also disclosed herein, according to various embodiments, is an output device assembly comprising a housing defining a chamber and a fluid inlet port. The output device assembly may also include a moveable member disposed within the chamber and a bracket coupled to and disposed around the housing and defining a fluid inlet channel configured to deliver fluid to the chamber via the fluid inlet port. In various embodiments, the moveable member is configured to undergo activation movement within the chamber to produce an output (e.g., an actuator output). In various embodiments, the output device is configured such that the activation movement can be initiated in response to two different types, separately, of input. In various embodiments, the two different types of input comprise mechanical force on the moveable member and fluid pressurization of the chamber.

A first aspect of the disclosure relates to an output device that includes a movable member (e.g., a firing pin). A first actuation configuration of the output device is operable to initiate an output, where this output includes/utilizes a movement of the movable member. A second actuation configuration of the output device is also operable to initiate such an output. The first actuation configuration and the second actuation configuration differ in at least some respect.

The first actuation configuration of the output device may utilize an actuatable release (e.g., a sear pin), that when actuated (e.g., by exertion of a mechanical force on the release, including a manual force) releases an initiation actuator of the output device (e.g., a piston). The initiation actuator may be biased toward the movable member to impact and advance the movable member when released and to generate/provide the output. In various embodiments this entails the movable member being in the form of a firing pin and using movement of the initiation actuator to cause an impact between the firing pin and a primer. Ignition of the primer may generate a gaseous output, which may include high heat, hot particle, and/or pressure output. The output may include the gaseous output from the ignited primer.

The second actuation configuration of the output device may utilize a fluid path to a chamber in which the movable element is disposed. Directing an appropriate fluid through the fluid path and into the chamber may be utilized to advance the movable member to generate/provide the output. In various embodiments this entails the movable member being in the form of a firing pin and using movement of the initiation actuator to cause an impact between the firing pin and a primer. Ignition of the primer may generate a gaseous output. The output may include the gaseous output from the ignited primer. Based upon the foregoing, a first input to the output device may be in the form of a mechanical signal and that may be used to generate the output, and a second input to the output device may be in the form of a fluid signal that may be used to generate this same output.

Also disclosed herein, according to various embodiments, is an output device comprising a housing defining a chamber, a firing pin disposed within the chamber, an initiation actuator disposed within the chamber. The initiation actuator may be aligned with the firing pin and disposed on a first side of the firing pin. The output device may also include a primer for a ballistic combustion system coupled with the housing, aligned with firing pin, and disposed on an opposite second side of the firing pin. The output device may further include an initiation fluid port extending through the housing and to the chamber on the first side of the firing pin. According to various embodiments, the firing pin is configured to undergo activation movement within the chamber to produce an output. In various embodiments, the output device is configured such that the activation movement of the firing pin provides an initiating impact force to the primer, wherein the output device is configured such that the activation movement of the firing pin can be initiated in response to different types, separately, of input. The different types of input may comprise exertion of a mechanical force on the moveable member by the initiation actuator and fluid pressurization of the chamber through the initiation fluid port.

In various embodiments, the output device further includes a sear pin releasably coupled to the initiation actuator. In various embodiments, the output device further comprises a biasing member disposed between the initiation actuator and the housing, wherein compression of the biasing member in a first direction, in response to exertion of a mechanical force on the sear pin, and subsequent expansion of the biasing member in a second direction opposite the first direction, produces the activation movement of the firing pin.

Also disclosed herein, according to various embodiments, is a method of operating an output device comprising a movable member. The method may include providing at least one of a first input and a second input to the output device, wherein the first input is different from the second input. The method may further include generating an output from the providing, wherein the generating comprises advancing the movable member in response to the providing. In various embodiments, the first input comprises a mechanical input and the second input comprises a pressurized fluid input.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1A:
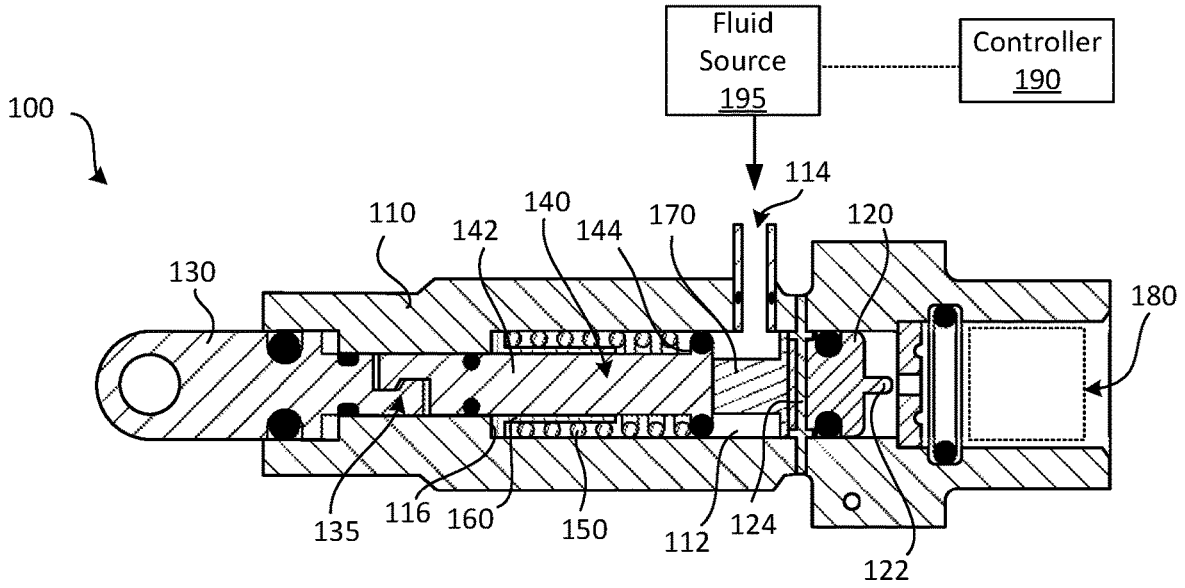
FIGS. 1A and 2A are cross-sectional views of dual-input output devices, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

Disclosed herein, according to various embodiments, is an output device and/or an output device assembly that is configured to be initiated in response to different types of input. That is, the disclosed output device is generally configured so as to be able to receive different types of input in order to produce an output (e.g., the same type of output, regardless of the input). For example, the two different, representative types of device input may be mechanical force (or a mechanical signal) and fluid pressure (or a fluid signal), and thus the disclosed output device may be able to receive either form of input and convert either type into a predetermined output, as described in greater detail below.

Figure 2A:
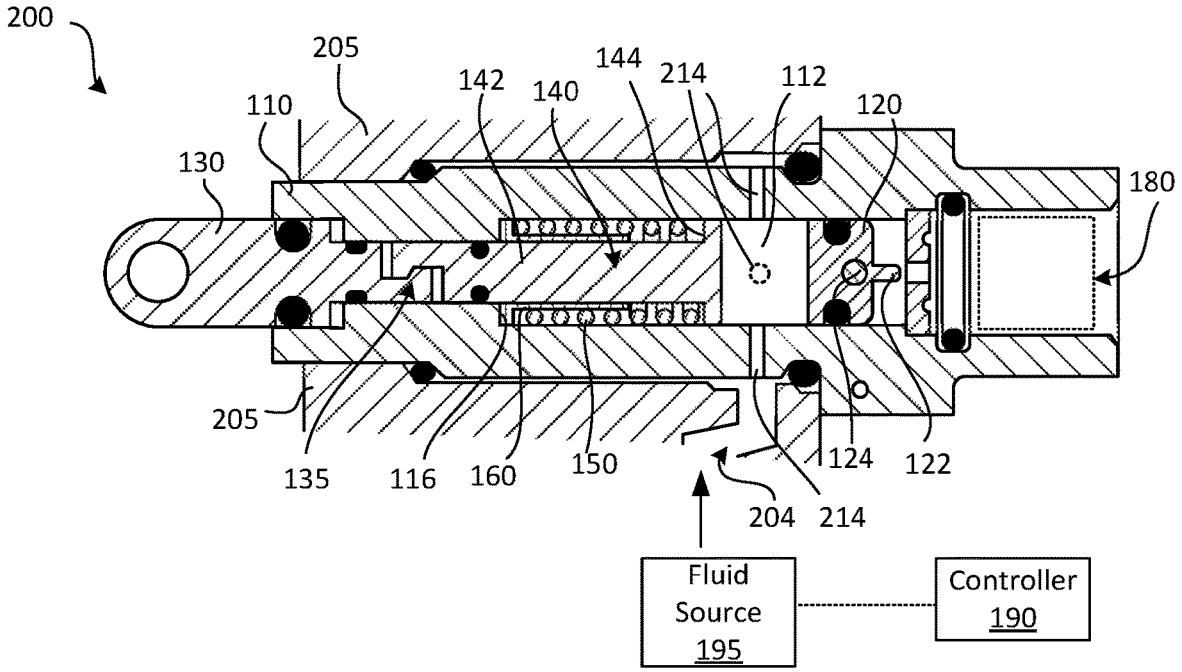

In various embodiments, and with reference to FIGS. 1A and 2A, the output device 100/200 generally includes a housing 110 and a moveable member 120. The housing 110 defines a chamber 112, such as a central/longitudinal chamber, and the moveable member 120 may be disposed within the chamber 112, according to various embodiments. The moveable member 120 is generally configured to undergo activation movement within the chamber 112 to produce an output, according to various embodiments. The output device 100/200 may be configured such that the activation movement (experienced by the moveable member 120) can be initiated in response to two different types, separately, of input. As used in this context, the term "separately" refers to the fact that either type of input is sufficient to produce the output. Thus, "separately" does not necessarily preclude both types of input being received simultaneously by the output device 100/200, but merely is used to clarify that both inputs are not required to produce the output.

The two output devices 100/200 depicted in FIGS. 1A and 2A comprise many of the same or similar components, and for the sake of clarity the same reference numbers are used herein when referring to components that are the same as or substantially similar to each other in both embodiments. The main difference between the two output devices 100/200, as described in greater detail below, pertain to how fluid is delivered to the output device 100/200. That is, the embodiment of FIG. 2A shows a bracket 205 (e.g., an outer housing) that receives the housing of the output device 200, with the bracket 205 defining a fluid inlet channel 204 through which fluid is routed to arrive at the output device 200. Additional details pertaining to these features and the differences between the embodiments are included below.

In various embodiments, the two different types of input comprise mechanical force on the moveable member 120 and fluid pressurization of the chamber 112, as described in greater detail below. That is, the output may be triggered in response to either mechanical force exerted on components of the output device 100/200 or introduction of pressurized fluid (e.g., pneumatic, hydraulic, ballistic pressure, etc.) into the output device 100/200. In various embodiments, regardless of which type of input is received by the output device 100/200, the output device 100/200 is configured to convert the input into movement (i.e., activation movement) of the moveable member 120, and the activation movement may be the output (e.g., linear translation) or the activation movement may trigger the output, as described in greater detail below.

In various embodiments, the output device 100/200 is configured to produce a ballistic output (e.g., for space launch vehicles, aircraft ejection seats, etc.), and thus the output device 100/200 may include a primer 180 for a ballistic combustion system. Said differently, the moveable member 120 may be a firing pin 120 and the activation movement of the firing pin 120 provides an initiating impact force to the primer 180 to initiate the ballistic combustion. More specifically, the firing pin 120 may include a tip 122 that is configured to penetrate, impact, or otherwise contact a membrane of a primer 180 to imitate primer combustion. In various embodiments, the moveable member 120 (e.g., the firing pin 120) may be retained in place (away from contact with the primer 180) by a shear pin 124. The shear pin 124 may break in response to the activation movement of the firing pin 120, thereby releasing the firing pin 120 to impact the primer 180.

Returning to the concept of dual inputs, the first type of input that is able to initiate the output device 100/200 may be fluid pressurization of the chamber 112 (e.g., on one side of the movable member 120). That is, in response to fluid (e.g., air, hydraulic fluid, ballistic pressure, etc.) being delivered to the chamber 112 of the housing 110, the pressure within the chamber 112 may increase, thereby forcing the moveable member 120 to move within the chamber 112 (i.e., causing the moveable member 120 to experience the activation movement). As introduced above, FIGS. 1A and 2A show different configurations/structures for delivering fluid to the chamber 112. In various embodiments, and with specific reference to FIG. 1A, the housing 110 of the output device 100 may define a fluid inlet port 114 through which fluid is supplied to the chamber 112.

However, in various embodiments and with specific reference to FIG. 2A, the output device/output device assembly 200 includes an external bracket 205 that at least partially surrounds the housing 110, and the bracket 205 defines a fluid inlet channel 204. In such a configuration, the housing 110 may still define one or more fluid inlet ports 214 that extend through the wall of the housing 110, and the fluid inlet channel 204 of the bracket 205 may deliver fluid through the fluid inlet ports 214 of the housing 110. In various embodiments, the housing 110 defines a plurality of fluid inlet portions 214 that are circumferentially distributed around the chamber 112 of the housing 110. By utilizing the bracket 205, fluid introduction may be facilitated, as instead of having to attach a fluid delivery conduit to the port 114 of FIG. 1A, the engagement of the bracket 205 around/against the outer surface of the housing 110 may define an annular space for fluid communication between the bracket 205 and the housing 110, thus allowing for some play/tolerances, and may also allow for a spent/used output device to be replaced with a new one (or refurbished for use again). In various embodiments, one or more O-rings (e.g., a set of O-rings) may be positioned between the radially outward surface of the housing 110 and the radially inward surface of the bracket 205, thereby substantially fluidly sealing the aforementioned annular space.

Again returning to the concept of multiple or dual inputs, the second type of input that is able to initiate the output device may be mechanical force. That is, mechanical force may trigger the activating motion of the moveable member 120 in order to effectuate the output. In various embodiments, the output device 100/200 may include a spring-driven mechanism that is generally configured to propel the moveable member 120. For example, the output device 100/200 may include a sear pin 130 that is coupled to the moveable member 120 (e.g., the firing pin 120), with mechanical force on the sear pin 130 producing the activation movement of the moveable member 120. The sear pin 130 may be partially disposed within the chamber 112 of the housing 110, and may be manually graspable by a user or may be mechanically linked to other intermediary components to transfer a linear translation to the output device 100/200.

In various embodiments, the output device 100/200 further includes a piston 140 (e.g., an initiation actuator) disposed within the chamber 112 of the housing 110. As described below, the piston 140 may be configured to be biased toward the moveable member 120 by a spring or other element 150. The piston 140 may generally be disposed between the sear pin 130 and the moveable member 120. In various embodiments, the sear pin 130 is releasably coupled to the piston 140. That is, respective adjoining ends of the sear pin 130 and the piston 140 may have an interlocking configuration 135 that allows for tension exerted on the sear pin 130 to be transferred to the piston 140. In various, embodiments, the interlocking configuration 135 allows for an axial tension force exerted on the sear pin 130 to be transferred to the piston 140. In various embodiments, the interlocking configuration 135 enables the sear pin 130 to move in a radially offset direction in response to the sear pin 130 being sufficiently removed from the end of the housing 110 (e.g., see FIGS. 1B and 2B). That is, the sear pin 130, once sufficiently removed from and no longer confined within a first chamber section having a first cross-sectional dimension is able to move in a radial direction (in a second chamber section having a second cross-sectional dimension that is larger than the first cross-sectional dimension) to disengage the interlocking configuration 135. In various embodiments, the mating surfaces of the interlocking configuration are slanted or oblique, thus enabling the sear pin 130 to slide radially outward in response to the sear pin 130 being pulled into the larger second chamber section of the housing 110. The pulling/tension may compress a spring or other biasing mechanism 150, and once the sear pin 130 has been pulled a predetermined distance, which may be defined by the shape of the end of the housing, the interlocking coupling configuration between the sear pin 130 and the piston 140 may be released to allow the spring 150 to expand to propel/drive the piston 140 toward the moveable member 120 to produce the activation movement of the movable member 120.

Figure 1B:
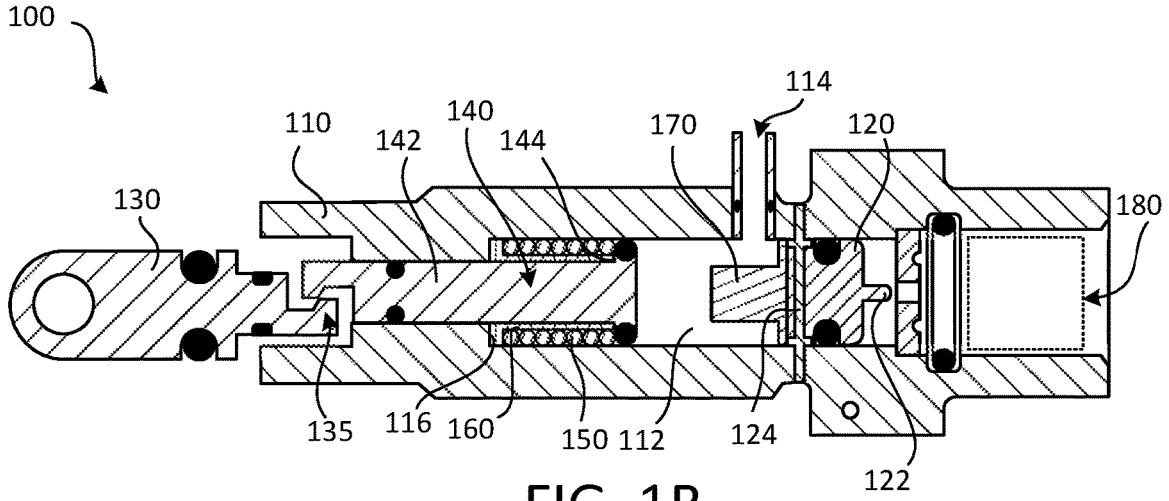
FIGS. 1B and 2B are cross-sectional views of dual-input output devices, showing device components at an intermediate stage of converting mechanical force input to an output, in accordance with various embodiments.
Figure 2B:
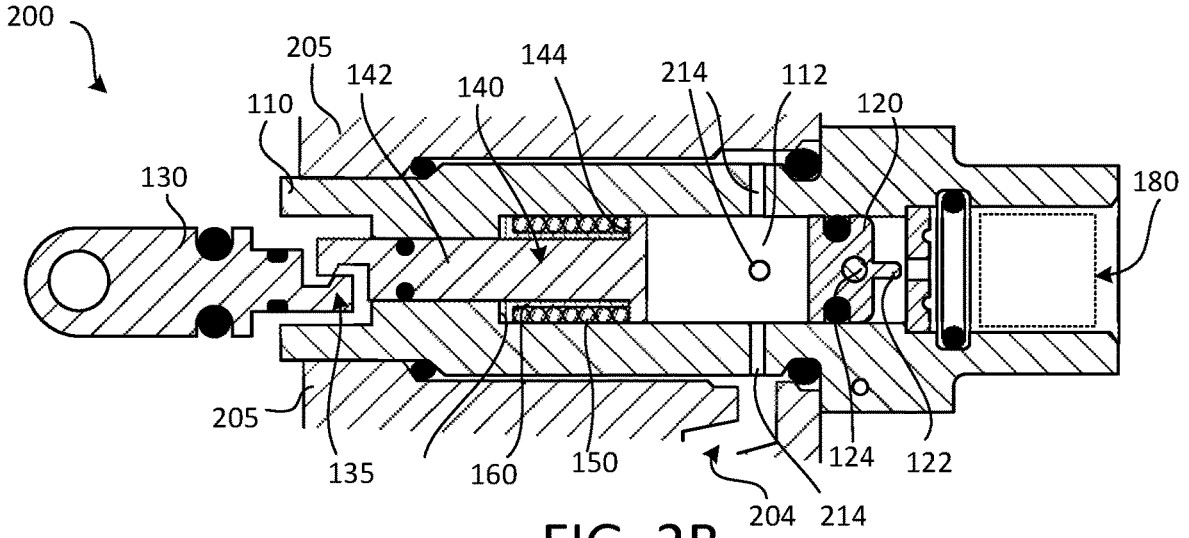
Figure 1C:
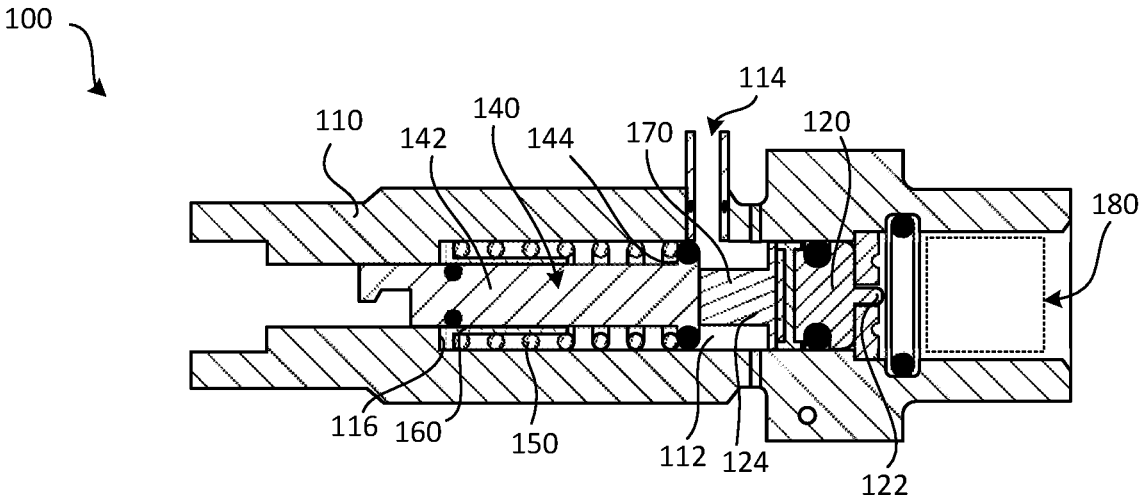
FIGS. 1C and 2C are cross-sectional views of dual-input output devices, showing device components at an output stage of converting mechanical force input to an output, in accordance with various embodiments.
Figure 2C:
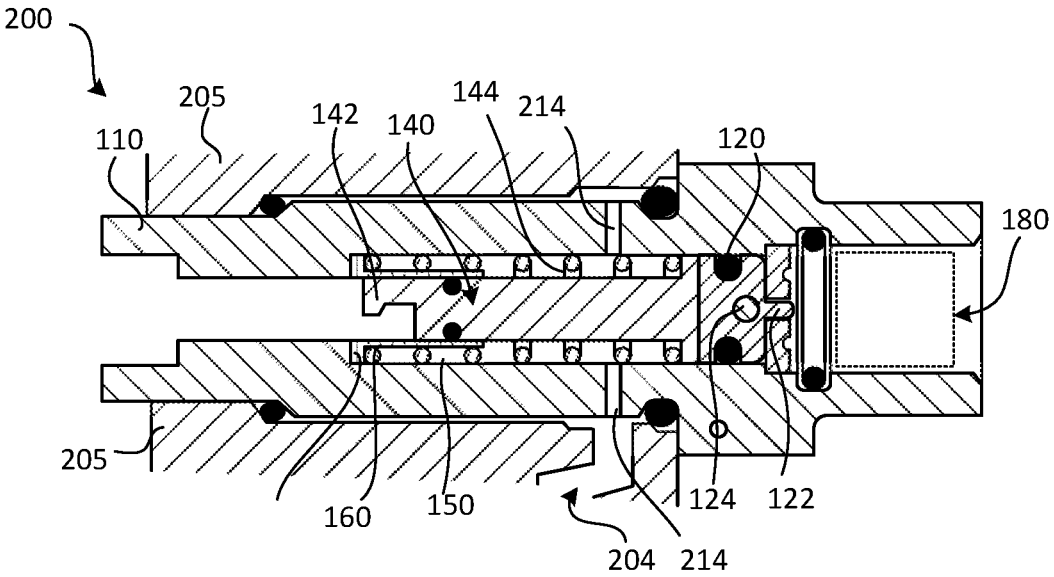

In various embodiments, and with reference to the loading/intermediate stage shown in FIGS. 1B and 2B, the output device 100/200 also includes a coil spring 150 disposed around a shaft portion 142 of the piston 140, with the coil spring 150 retained between a piston head 144 of the piston 140 and a shoulder 116 of the housing 110. Such a configuration enables the coil spring 150 to be compressed in a first direction in response to the mechanical force (e.g., exerted on the sear pin 130). In various embodiments, and with reference to FIGS. 1C and 2C, subsequent expansion of the coil spring 150 (e.g., after release of the coupling between the sear pin 130 and the piston 140) causes the piston 140 to move in a second direction opposite the first direction to produce the activation movement of the moveable member 120. In various embodiments, an O-ring or other comparable sealing feature may be disposed around the piston head 144 to facilitate fluid sealing and thus preventing fluid from moving into the region of the chamber 112 where the spring is housed.

In various embodiments, the output device 100/200 includes a spacer 170 disposed between the piston head 144 and the moveable member 120. The spacer 170 may occupy volume between the piston 140 and the moveable member 120 to facilitate force transfer between the piston 140 and the moveable member 120. In various embodiments, the spacer 170 helps to define an annular chamber (i.e., a volume defined between the radially outward surface of the spacer 170 and the radially inward surface of the housing 110) into which the fluid may be delivered. That is, the spacer 170 may facilitate/ensure a volume is available to receive the pressurization fluid entering the chamber 112 via the fluid inlet port(s) 114/214, and thus these fluid inlet port(s) 114/214 may be directly open to this annular chamber region around the spacer 170. In various embodiments, the spacer 170 is configured to direct flow of fluid towards the moveable member 124, and thus may have curved or slanted surfaces to facilitate the redirection of fluid from a radial inlet direction to an axial direction, or at least closer to the axial direction. Although the spacer 170 is exclusively shown in FIGS. 1A, 1B, and 1C, the spacer 170 be implemented in conjunction with the details and configuration shown in FIGS. 2A, 2B, and 2C.

In various embodiments, the output device 100/200 may further include a sleeve 160 disposed around the shaft portion 142 of the piston 140. The sleeve 160 may be configured to extend between and abut the shoulder 116 of the housing 110 and the piston head 144 of the piston 140 (when the coil spring 150 is compressed) to limit extent of travel of the piston 140. In various embodiments, the sleeve 160 may help to prevent over compression of the coil spring.

In various embodiments, the output device 100/200 and/or the system in which the output device 100/200 is utilized includes a controller 190, and the controller 190 may be configured to automate one or both types of input (e.g., the controller could be configured to actuate the sear pin 130). The controller may send a signal to a fluid source 195 to initiate delivery of hydraulic or pneumatic fluid to the output device 100/200 in order to effectuate the output. For example, the output device 100/200 may be utilized in an ejection seat environment, and instead of exclusively relying on the pilot of an aircraft to manually initiate an ejection sequence (which may be the input received/handled by the sear pin 130), the output device 100/200 may be configured to alternatively receive input from a controller 190 by introducing fluid to the output device 100/200 to cause the desired output (e.g., ignition of primer, which propagates to a ballistic ignition of the ejection seat propulsion system).

In various embodiments, the controller 190 may be coupled to, affixed to, or integrated into the housing of the output device 100/200, or the controller 190 may be integrated into computer systems onboard a broader system (e.g., an aircraft). In various embodiments, the controller 190 comprises a processor. In various embodiments, the controller 190 is implemented in a single processor. In various embodiments, the controller may be implemented as and may include one or more processors and/or one or more tangible, non-transitory memories and be capable of implementing logic. Each processor can be a general purpose processor, a digital signal processor (DSP), an application specific integrated circuit (ASIC), a field programmable gate array (FPGA) or other programmable logic device, discrete gate or transistor logic, discrete hardware components, or any combination thereof. The controller may comprise a processor configured to implement various logical operations in response to execution of instructions, for example, instructions stored on a non-transitory, tangible, computer-readable medium (i.e., the memory) configured to communicate with the controller. Furthermore, any number of conventional techniques for electronics configuration, signal processing and/or control, data processing and the like may be employed. Also, the processes, functions, and instructions may include software routines in conjunction with processors, etc.

System program instructions and/or controller instructions may be loaded onto a non-transitory, tangible computer-readable medium having instructions stored thereon that, in response to execution by the processor, cause the controller to perform various operations. The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An output device comprising:

a housing comprising a chamber;

a movable member disposed within the chamber, wherein the movable member is configured to undergo activation movement within the chamber to produce an output;

a first actuation configuration operable to initiate the activation movement of the movable member;

a second actuation configuration operable to initiate the activation movement of the movable member, wherein the first actuation configuration and the second actuation configuration are different;

a piston disposed within the chamber between a sear pin and a firing pin of the movable member;

a coil spring disposed around a shaft portion of the piston between the piston and the housing, wherein the coil spring is retained between a piston head of the piston and a shoulder of the housing; and a sleeve disposed around the shaft portion of the piston between the coil spring and the shaft portion of the piston, wherein the sleeve is configured to extend between and abut the shoulder of the housing and the piston head of the piston to limit the extent of travel of the piston in a first direction in order to limit compression of the coil spring.

2. The output device of claim 1, wherein the first actuation configuration comprises a mechanical release, and wherein the second actuation configuration comprises a pressurization section of the chamber operatively connected with the movable member.

3. The output device of claim 1, further comprising a primer for a ballistic combustion system, wherein the activation movement of the firing pin provides an initiating impact force to the primer.

4. The output device of claim 3, wherein the output device is configured such that exertion of a mechanical force on the sear pin results in the activation movement of the firing pin.

5. The output device of claim 4, wherein the sear pin is releasably coupled to the piston.

6. The output device of claim 4, wherein the compression of the coil spring in the first direction, in response to the mechanical force on the sear pin, and subsequent expansion of the coil spring in a second direction opposite the first direction produces the activation movement.

7. The output device of claim 6, wherein the output device is configured to release the sear pin from the piston in response to a predetermined threshold linear translation, thereby causing the subsequent expansion of the coil spring to propel the piston toward the firing pin to produce the activation movement.

8. The output device of claim 7, wherein the firing pin is retained in place using a shear pin, wherein in response to the piston impacting the firing pin the shear pin is configured to break to allow for the activation movement of the firing pin.

9. The output device of claim 3, wherein the housing defines a fluid inlet port that extends to a pressurization section of the chamber, wherein the output device is configured such that fluid pressurization of the pressurization section of the chamber via the fluid inlet port produces the activation movement of the firing pin.

10. The output device of claim 9, further comprising a spacer disposed between the piston and the firing pin.

11. The output device of claim 10, wherein an annular chamber is defined between the spacer and the housing, wherein the fluid inlet port is directly open to the annular chamber.

12. The output device of claim 10, wherein the firing pin is retained in place using a shear pin, wherein in response to fluid pressurization of the chamber, the shear pin is configured to break to allow for the activation movement of the firing pin.

13. An output device comprising:

a housing defining a chamber;

a firing pin disposed within the chamber;

an initiation actuator disposed within the chamber between a sear pin and the firing pin, aligned with the firing pin, and disposed on a first side of the firing pin;

a biasing member disposed around a shaft portion of the around a shaft portion of the between the initiation actuator and the housing, wherein the biasing member is retained between a head of the initiation actuator and a shoulder of the housing;

a sleeve disposed around the shaft portion of the initiation actuator between the biasing member and the shaft portion of the initiation actuator, wherein the sleeve is configured to extend between and abut the shoulder of the housing and the head of the initiation actuator to limit the extent of travel of the initiation actuator in a first direction in order to limit compression of the biasing member;

a primer for a ballistic combustion system coupled with the housing, aligned with firing pin, and disposed on an opposite second side of the firing pin; and an initiation fluid port extending through the housing and to the chamber on the first side of the firing pin;

wherein the firing pin is configured to undergo activation movement within the chamber to produce an output;

wherein the output device is configured such that the activation movement of the firing pin provides an initiating impact force to the primer;

wherein the output device is configured such that the activation movement of the firing pin can be initiated in response to different types, separately, of input; and wherein the different types of input comprise exertion of a mechanical force on a movable member by the initiation actuator and fluid pressurization of the chamber through the initiation fluid port.

14. The output device of claim 13, wherein the sear pin is releasably coupled to the initiation actuator.

15. The output device of claim 14, wherein compression of the biasing member in the first direction, in response to exertion of a mechanical force on the sear pin, and subsequent expansion of the biasing member in a second direction opposite the first direction, produces the activation movement of the firing pin.

* * * * *